US012523004B2

(12) United States Patent
Faivre et al.

(10) Patent No.: US 12,523,004 B2
(45) Date of Patent: Jan. 13, 2026

(54) SYSTEMS AND METHODS FOR DETERMINING POOR IMPLEMENT PENETRATION

(71) Applicant: Caterpillar Inc., Peoria, IL (US)

(72) Inventors: Joseph L. Faivre, Edelstein, IL (US); Bradley P. Krone, Dunlap, IL (US); Sangameshwar Sonth, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 340 days.

(21) Appl. No.: 17/804,472

(22) Filed: May 27, 2022

(65) Prior Publication Data

US 2023/0383496 A1 Nov. 30, 2023

(51) Int. Cl.
*E02F 3/84* (2006.01)
*E02F 9/26* (2006.01)

(52) U.S. Cl.
CPC ..... *E02F 3/844* (2013.01); *E02F 9/262* (2013.01)

(58) Field of Classification Search
None
See application file for complete search history.

(56) References Cited

U.S. PATENT DOCUMENTS

| | | | | |
|---|---|---|---|---|
| 9,481,977 | B1 | 11/2016 | Clar et al. | |
| 9,903,096 | B2 | 2/2018 | Noborio et al. | |
| 9,909,284 | B2 | 3/2018 | DeVore et al. | |
| 10,066,367 | B1 | 9/2018 | Wang et al. | |
| 10,186,004 | B2 | 1/2019 | Wei et al. | |
| 10,604,912 | B2 | 3/2020 | Hashimoto et al. | |
| 10,669,699 | B2 | 6/2020 | Hashimoto et al. | |
| 10,767,341 | B2 | 9/2020 | Hashimoto | |
| 2013/0311031 | A1* | 11/2013 | Friend | E02F 9/262 701/50 |
| 2014/0180444 | A1 | 6/2014 | Edara et al. | |
| 2014/0180547 | A1* | 6/2014 | Edara | E02F 9/262 701/50 |
| 2016/0122969 | A1* | 5/2016 | Noborio | E02F 9/262 701/50 |
| 2017/0121939 | A1* | 5/2017 | Schaeding | E01C 19/48 |
| 2019/0093294 | A1* | 3/2019 | Payne | B60G 3/01 |
| 2020/0003557 | A1* | 1/2020 | Gazza | G01C 21/3848 |
| 2020/0011033 | A1* | 1/2020 | Sherlock | E02F 9/262 |
| 2020/0048870 | A1* | 2/2020 | Peat | E02F 3/764 |
| 2020/0063396 | A1* | 2/2020 | Ready-Campbell | G06T 17/05 |
| 2020/0102721 | A1* | 4/2020 | Wei | E02F 3/842 |
| 2020/0291616 | A1 | 9/2020 | Ishibashi et al. | |
| 2021/0032850 | A1* | 2/2021 | Holl | E02F 3/847 |

(Continued)

OTHER PUBLICATIONS

Written Opinion and International Search Report for Int'l. Patent Appln. No. PCT/US2023/019393, mailed Aug. 3, 2023 (12 pgs).

*Primary Examiner* — Jonathan M Dager
*Assistant Examiner* — Charles Pall

(57) ABSTRACT

A method of identifying blade penetration that is ineffectual by a blade-based machine at a work site, including: attempting to cut an area of ground by the blade-based machine at the work site; determining that the cut is ineffectual based on a determination of a threshold cut volume achieved by the blade-based machine, the threshold cut volume being based on input from one or more position sensors on the blade-based machine; and initiating one or more remedial actions based on the determination of ineffectual cutting by the blade-based machine.

20 Claims, 9 Drawing Sheets

(56) References Cited

U.S. PATENT DOCUMENTS

| | | | | |
|---|---|---|---|---|
| 2022/0333338 | A1* | 10/2022 | Hayakawa | E02F 9/264 |
| 2023/0138075 | A1* | 5/2023 | Rife | E01C 23/088 299/1.5 |

* cited by examiner

SYSTEMS AND METHODS FOR DETERMINING POOR IMPLEMENT PENETRATION

TECHNICAL FIELD

The present disclosure relates generally to determining poor implement penetration, and more specifically, to determining poor implement penetration and causing one or more remedial measures based thereon.

BACKGROUND

Machines such as dozers, motor graders, loaders, etc., may perform tasks at a work site. For example, these machines may move or grade constituent according to a work site plan. Machines with autonomous capabilities may operate in an autonomous or semi-autonomous manner to perform these tasks as part of a site plan for the machines. The machines may receive instructions in accordance with the site plan to autonomously or semi-autonomously perform operations such as digging, scraping carrying, etc., at the worksite.

Autonomously-capable machines can remain consistently productive in many environments with little or no human intervention. Some of these environments may be unsuitable or undesirable for a human operator(s). Additionally, some work sites may have unknown or unplanned obstacles that impede work. For example, hard or compacted material (e.g., rocky or frozen terrain) may be impenetrable by a blade of a bulldozer or another implement of mobile machinery. Such impediments may be known or unknown to worksite planners and may require various levels of intervention to resolve.

U.S. Pat. No. 10,066,367 ("the '367 patent"), describes a system configured to be mounted to a vehicle for adjusting a position of an implement (e.g., a blade) during an autonomous operation by the vehicle. The vehicle may monitor a height, slope angle, and/or load of the implement during an operation and adjust one or more parameters associated with the implement to achieve a desired terrain profile. However, the '367 patent does not address remedial actions to loosen hard or compacted material in all situations.

The features of the present disclosure may solve one or more of the problems set forth above and/or other problems in the art. The scope of the current disclosure, however, is defined by the attached claims, and not by the ability to solve any specific problem.

SUMMARY

In one aspect, a method of identifying blade penetration that is ineffectual by a blade-based machine at a work site, includes: attempting to cut an area of ground by the blade-based machine at the work site; determining that the cut is ineffectual based on a determination of a threshold cut volume achieved by the blade-based machine, the threshold cut volume being based on input from one or more position sensors on the blade-based machine; and initiating one or more remedial actions based on the determination of ineffectual cutting by the blade-based machine.

In another aspect, a method for evaluating cut penetration of a cut made using a mobile machine and generating one or more remedial actions based thereon, includes determine an initial chassis angle of a chassis of the mobile machine; determine an initial pitch angle of a blade of the mobile machine; move the blade from the initial pitch angle to a cutting angle; determine a secondary chassis angle of the mobile machine; determine a secondary pitch angle of the mobile machine; take one or more remedial actions based on a difference between the initial pitch angle and the secondary pitch angle and a difference between the initial chassis angle and the secondary chassis angle.

In yet another aspect, a system for determining whether ground is impenetrable by a blade of a blade-based machine and initiating one or more remedial actions based on the determination, the system including: a blade-based machine including a blade and one or more position sensors on the blade-based machine; and a controller configured to: attempt to cut an area of ground using the blade of the blade-based machine; determine a threshold cut volume having a minimum blade penetration necessary to achieve the threshold cut volume; determine whether the threshold cut volume can be achieved based on input from one or more position sensors on the blade-based machine; and initiate one or more remedial actions based on an inability to achieve the threshold cut volume to penetrate the ground.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1A:
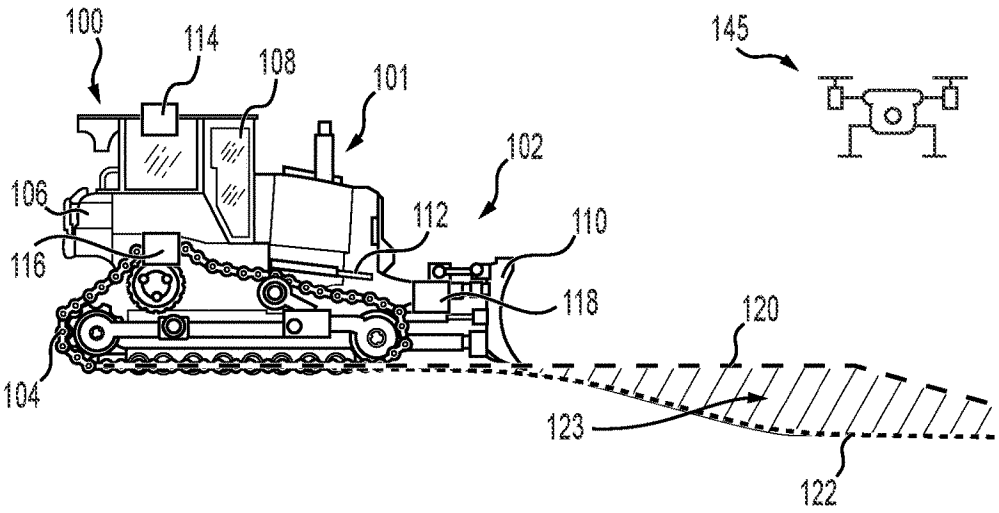
FIG. 1A is schematic representation of a mobile machine cutting along a desired terrain profile including a system for performing the cut using one or more autonomously capable systems, according to aspects of the disclosure.

FIG. 1A illustrates a mobile machine 101 including a system 100 for causing one or more remedial actions based on a determination of poor implement penetration as described in greater detail herein. As depicted, the mobile machine 101 is a blade-based machine (i.e., a track-type tractor including a blade), but other types of vehicles are contemplated and could implement the systems and methods described herein. For example, a motor grader, a backhoe loader, etc. The equipment implementing the systems and methods described herein could be track-based or wheel-based. The mobile machine 101 includes a base 102 (or a chassis) including right track 104 and a left track (not depicted), a main body 106, which may include a cabin 108, and a ground-engaging work implement such as blade 110. In the exemplary embodiment shown in FIG. 1A, the implement is a blade, but other implements are possible. The blade 110 may be movably coupled to one or more of the main body 106 and the base 102 using an arm 112. The arm 112 may be capable of moving the blade 110 through various poses and positions (e.g., pitch, roll, yaw) as described in greater detail herein. For example, one or more hydraulic cylinders coupled to the mobile machine 101 may support the blade 110 in the horizontal and vertical directions allowing the blade 110 to move up or down vertically and/or allow the pitch angle of the blade 110 to change relative to a centerline (not shown) of the mobile machine 101. A hydraulic system (not shown) may include sensors for monitoring pressure within the system as well as the pressure of specific cylinders. In some embodiments, the mobile machine 101 may be configured to communicate externally and may communicate externally to receive, for example, information captured by a drone 145. The drone 145 may have various perception systems aboard which may enable terrain imaging and/or mapping. For example, the drone 145 may include one or more cameras and/or LiDAR systems.

The mobile machine 101 includes various systems for determining its position and orientation in space and/or the position and orientation of one or more of its component parts in space (e.g., the blade 110). For example, the mobile machine 101 may include one or more global positioning systems (GPS) 114, and one or more inertial measurement units (IMU) 116, and a blade position sensor 118. In some embodiments, one or more of the blade position sensors 118 are IMUs. The GPS 114, the IMU 116, and the blade position sensor 118 may be position sensors that are part of a perception system of the mobile machine, which perception system may include other active and passive sensors and devices to sense the environment surrounding the mobile machine 101 (e.g., LiDAR, radar, sonar, visual cameras, etc.) The mobile machine 101 may be configured to operate autonomously or to be remotely controlled (e.g., by a control center) or may have one or more autonomous or remote capabilities that are enacted via a control system. The control system may be located on the machine 101 and/or may be located at a command center (not depicted) located remotely from the machine. In certain embodiments, the functionality of control system may be distributed so that certain functions are performed at machine 101 and other functions are performed at the command center. For example, a network system such as wireless network system (not depicted) may provide generalized commands or information to the machine 101 that the portions of control system on the machine 101 may utilize to generate specific commands to operate the various systems. In some embodiments, aspects of the control system remote from the machine 101 may provide some or all of the specific commands that are then transmitted by the wireless network system to systems of the machine. The mobile machine 101 may be one of several machines operating at a work site, each of which may communicate with the wireless network system.

Still referring to FIG. 1A, the mobile machine 101 may be used to form one or more cuts (i.e., the removal or moving of dirt or other constituent) from a terrain surface, such as the current terrain surface 120. The mobile machine 101 may be configured to autonomously remove constituent from a terrain surface based on, for example, one or more specifications or plans received from a remote operator or planner ("remote controller"). The mobile machine 101 may be configured to remove constituent based on, for example, a target cut profile 122. The target cut profile 122 may be a profile or a topographical plan for a desired cut or grade for removing constituent from a worksite, which profile may be generated, for example, using one or more terrain mapping modules, for instance in terrain mapping software. In some embodiments, the system 100 may be configured to, for example, measure a real time position of the mobile machine 101 and/or the blade 110, generate instructions to move the mobile machine 101 and/or the blade 110, and plot a path for the mobile machine 101 to points on the topographical plan to generate one or more cuts. The target cut profile 122 has a target cut volume 123 (i.e., the volume of constituent necessary to move to perform the target cut) and may be based on a current terrain profile and a desired terrain profile. The target cut volume 123 may be scaled, for example, based on a size of the blade 110. In some embodiments, the target cut profile 122 may take the form of multiple target cuts, each of the multiple target cuts being a fraction of the complete target cut profile (e.g., multiple fractional target cuts each having a fractional target cut volume). The current terrain profile may be determined, for example, using GPS track mapping, one or more perception systems (e.g., a vehicle-based perception system), drone terrain mapping (e.g., using visual or LiDAR image data captured by the drone 145), satellite imagery, etc.

Figure 1B:
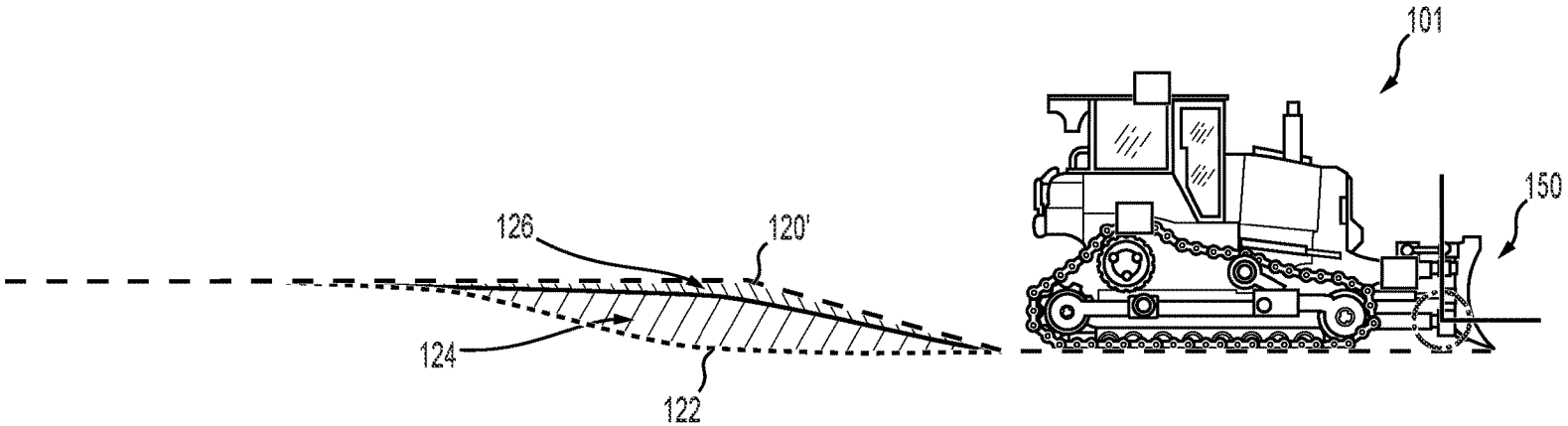
FIG. 1B shows the mobile machine of FIG. 1A after completing a cut along the desired terrain profile.

Referring now to FIG. 1B, the mobile machine 101 of FIG. 1A is shown after having performed a cut of the terrain surface 120'. The terrain surface 120' will have changed based on the cut. FIG. 1B shows a remaining cut volume 124 of the target cut profile 122. The remaining cut volume 124 is that portion of the target cut volume (based on the target cut profile 122) that remains after a cut. There may be some portion of constituent removed and/or displaced after the cut, though, and this removed/displaced portion of constituent may be referred to as an actual cut volume 126. Hence, the actual cut volume 126 may equal the target cut volume (as determined based on the target cut profile 122) less the remaining cut volume 124, and vice-a-versa. Any combination of ratios between these various volumes can be used to generate remedial actions if the ratios indicate that a cut is not successful as measured by the various systems and components of and connected to the mobile machine 101 as described in greater detail herein. For example, if determined that the actual cut volume was 95% of a target cut volume, there may not be any remedial cut or other remedial measures triggered. As a second example, if the actual cut volume is only 60% of a target cut volume, remedial actions may be triggered (e.g., additional cuts and other remedial measures as described herein).

In some embodiments, the mobile machine 101 may determine a threshold cut volume and may initiate remedial actions based on a determined cut volume not exceeding the threshold cut volume. The threshold cut volume may be, for example, 1% of the target cut volume, 2% of the target cut volume, 5% of the target cut volume, etc. In some embodiments, the mobile machine 101 and/or associated systems may make a determination regarding the efficacy of a cut based on the threshold cut volume. The threshold cut volume may be based on input from one or more position sensors on the mobile machine 101 as described in greater detail herein. Accordingly, if the mobile machine 101 identifies ineffectual cutting by the mobile machine 101 as determined through a comparison of a cut with the threshold cut volume, it may initiate the remedial actions. In some embodiments, the threshold cut volume may involve calculating a minimum blade penetration achieved using one or more position sensors.

Figure 2:
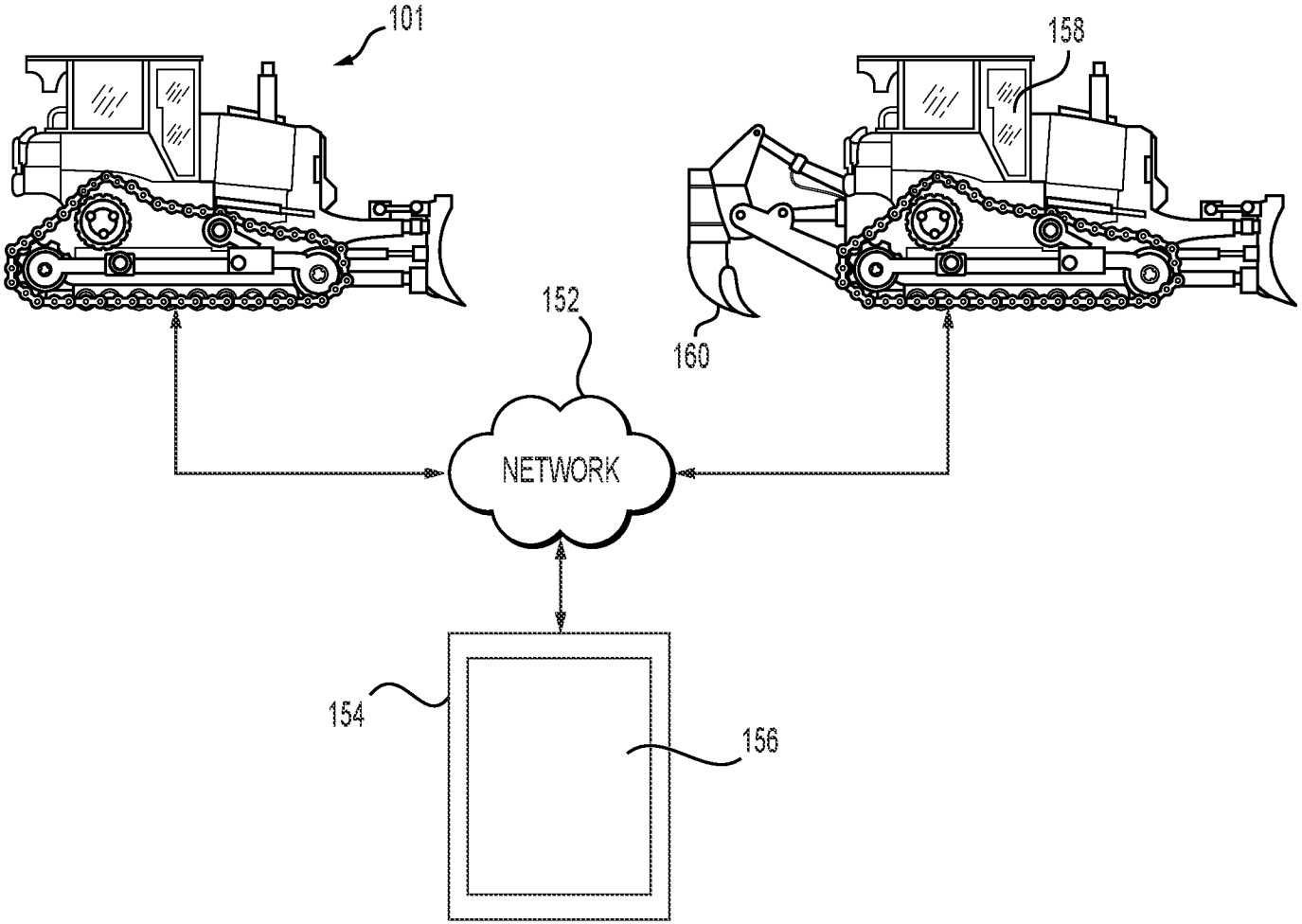
FIG. 2 is a schematic representation of a network for communicatively coupling the mobile machine of FIGS. 1A and 1B with a device and another mobile machine.

Referring to FIG. 2, a network 152 for communicatively coupling the mobile machine 101 with another mobile machine 158 and a device 154 including a display 156 is shown. The mobile machine 101 may be capable of contacting one or more other mobile machines, such as the other mobile machine 158 or a user of the system using the device 154 based on, for example, a determination of poor blade penetration as described herein. The other mobile machines may have additional or alternate implements (e.g., a ripper 160) which may be used to penetrate the terrain if the blade 110 (FIG. 1A) of the mobile machine 101 cannot. The network 152 may be, for example, a distributed network (e.g., a cloud network) which may provide data storage, connectivity, and computing power sufficient to perform at least some of the example functions described herein. In some embodiments, other devices or systems may communicatively couple to the network 152 (e.g., the drone 145 of FIG. 1A.) The mobile machine 101 may utilize the network 152 to request one or more remedial actions. For example, the mobile machine 101 may display a prompt to a user that indicates poor blade penetration on the display 156 such that the user can initiate one or more manually-implemented remedial measures (e.g., remotely using a device such as the device 154, for example, or locally causing the mobile machine 101 to perform another autonomous pass using the blade 110, to perform an autonomous ripping pass, to cause the other mobile machine 158 to perform a pass, etc.) As another example, the mobile machine 101 may request a pass over the area with insufficient penetration by the other mobile machine 158. The other mobile machine 158 may be a larger mobile machine with a greater capacity and/or capability for penetrating the ground at the job site. These are only exemplary remedial actions, and other actions are possible.

Referring now to FIGS. 3A-5B, a mobile machine 201 is depicted. The mobile machine 201 may be substantially similar to the mobile machine 101 of FIG. 1A and may include a base 202 including right track 204 and a left track (not depicted), a main body 206, which may include a cabin 208, and a blade 210. The exemplary embodiment shown in FIG. 3A includes a blade but other implements are possible. The blade 210 may be movably coupled to one or more of the main body 206 and the base 202 using an arm 212. The arm 212 may be capable of moving the blade 210 through various dimensions as described in greater detail herein. The mobile machine 201 includes various systems for determining its position and orientation in space and/or the position and orientation of one or more of its component parts in space (e.g., the blade 210). For example, the mobile machine 201 may include one or more GPSs 114, and one or more inertial IMUs 116, and one or more blade position sensors 118. In some embodiments, one or more of the blade position sensors 118 are IMUs. The mobile machine 201 may be configured to communicatively couple to external systems (e.g., a drone such as the drone 145 of FIG. 1) or networks (e.g., the network 152 of FIG. 2) and may be configured to operate autonomously or to be remotely controlled or may have one or more autonomous or remote capabilities.

Figure 4A:
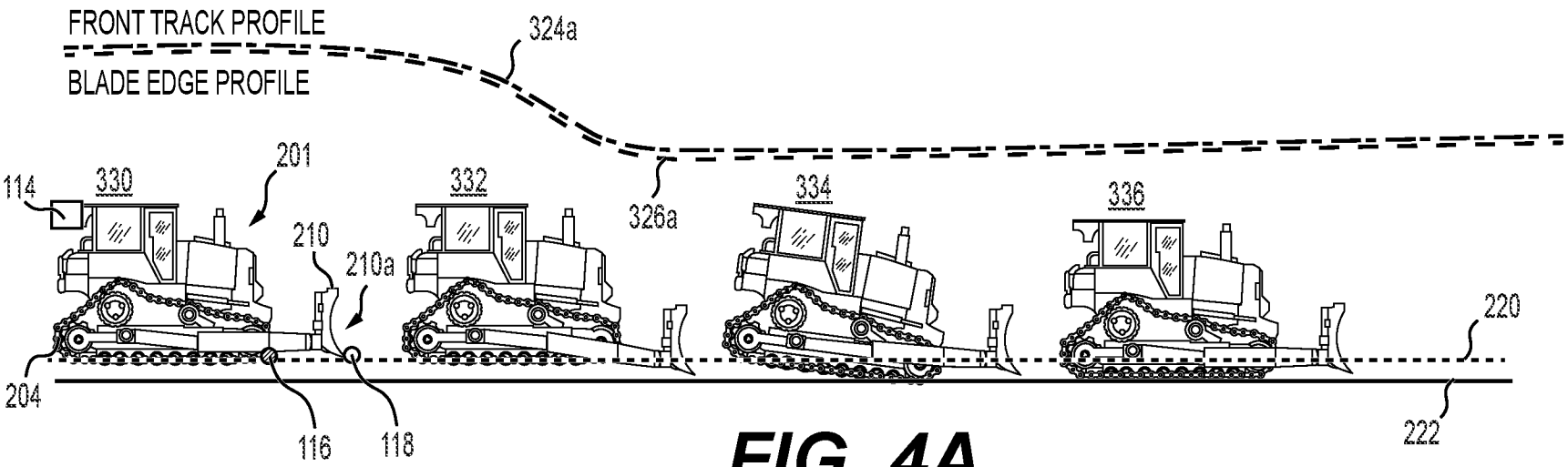
FIG. 4A shows the mobile machine of FIG. 3A in a scenario in which sufficient cut penetration could be determined using sensors at various locations on the body of the mobile machine.
Figure 4B:
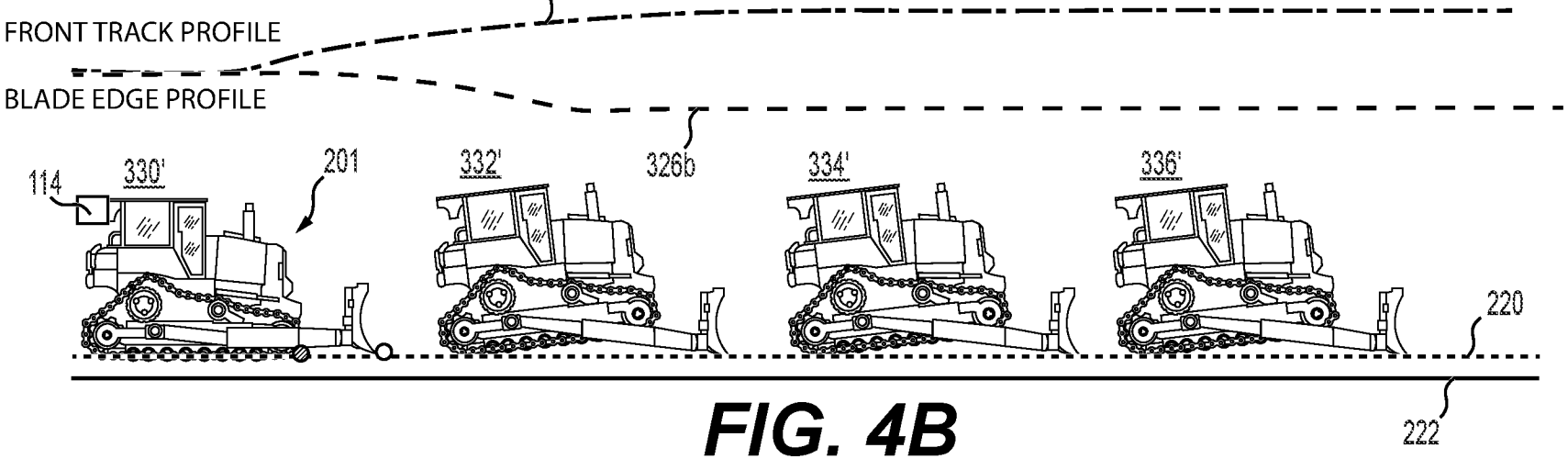
FIG. 4B shows the mobile machine of FIG. 4A in which insufficient cut penetration could be determined based on the sensors of FIG. 4A.
Figure 5A:
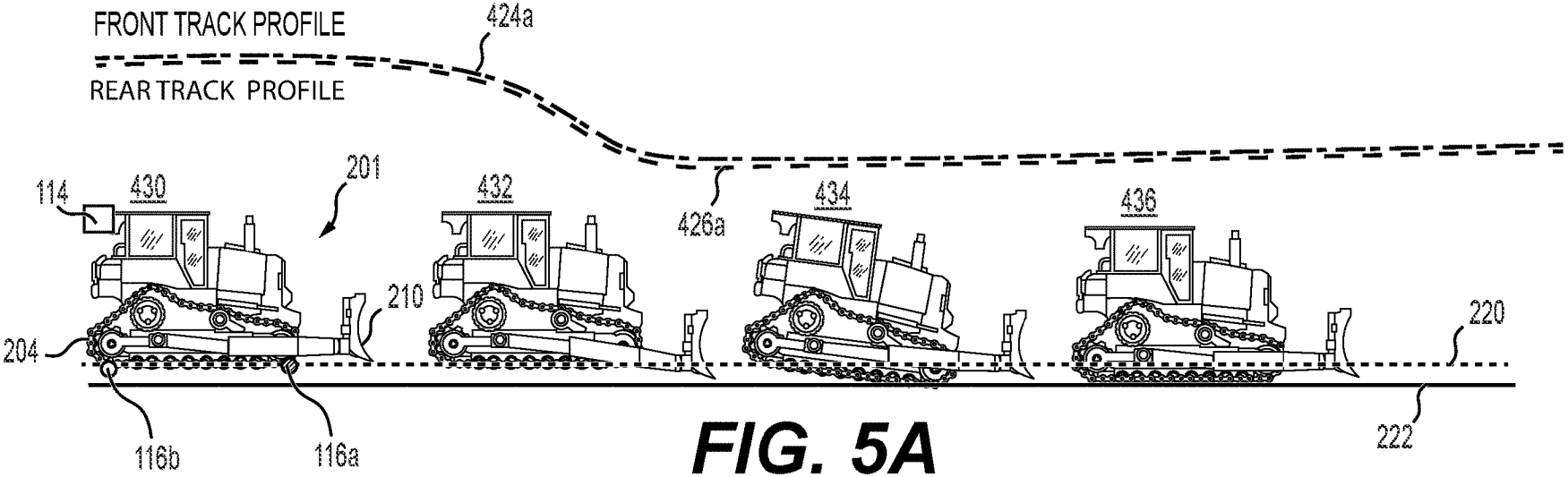
FIG. 5A shows the mobile machine of FIG. 3A in a scenario in which sufficient cut penetration could be determined using sensors at various locations on the body of the mobile machine.
Figure 5B:
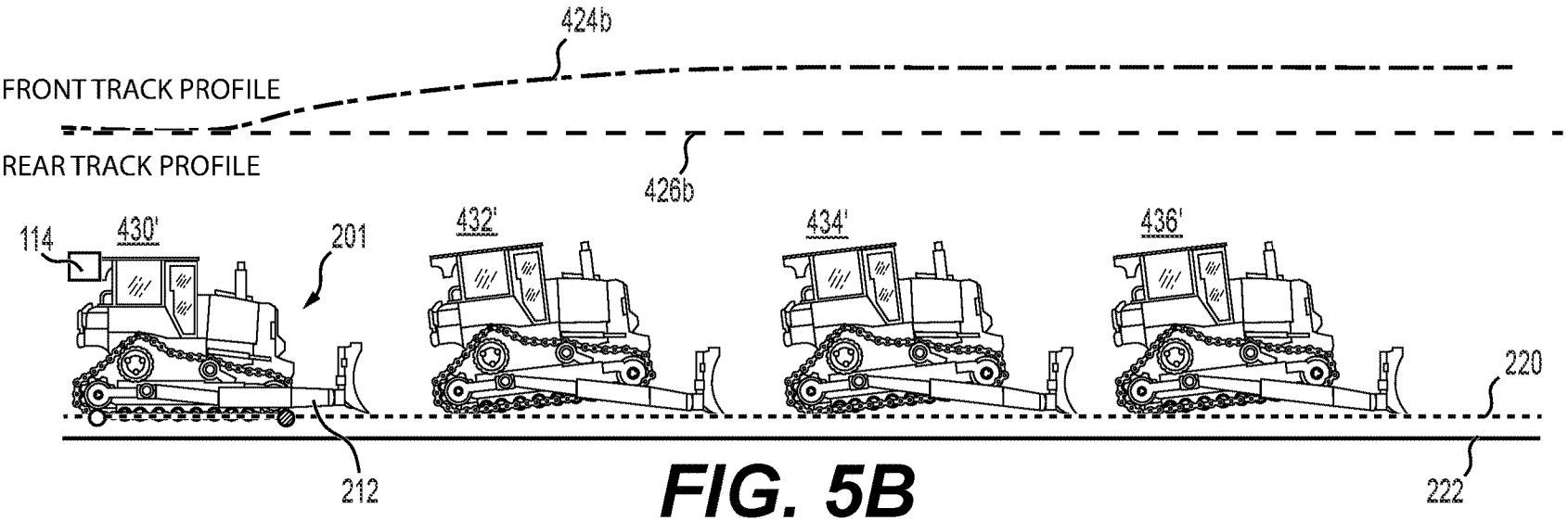
FIG. 5B shows the mobile machine of FIG. 5A in which insufficient cut penetration could be determined based on the sensors of FIG. 5A.
Figure 6:
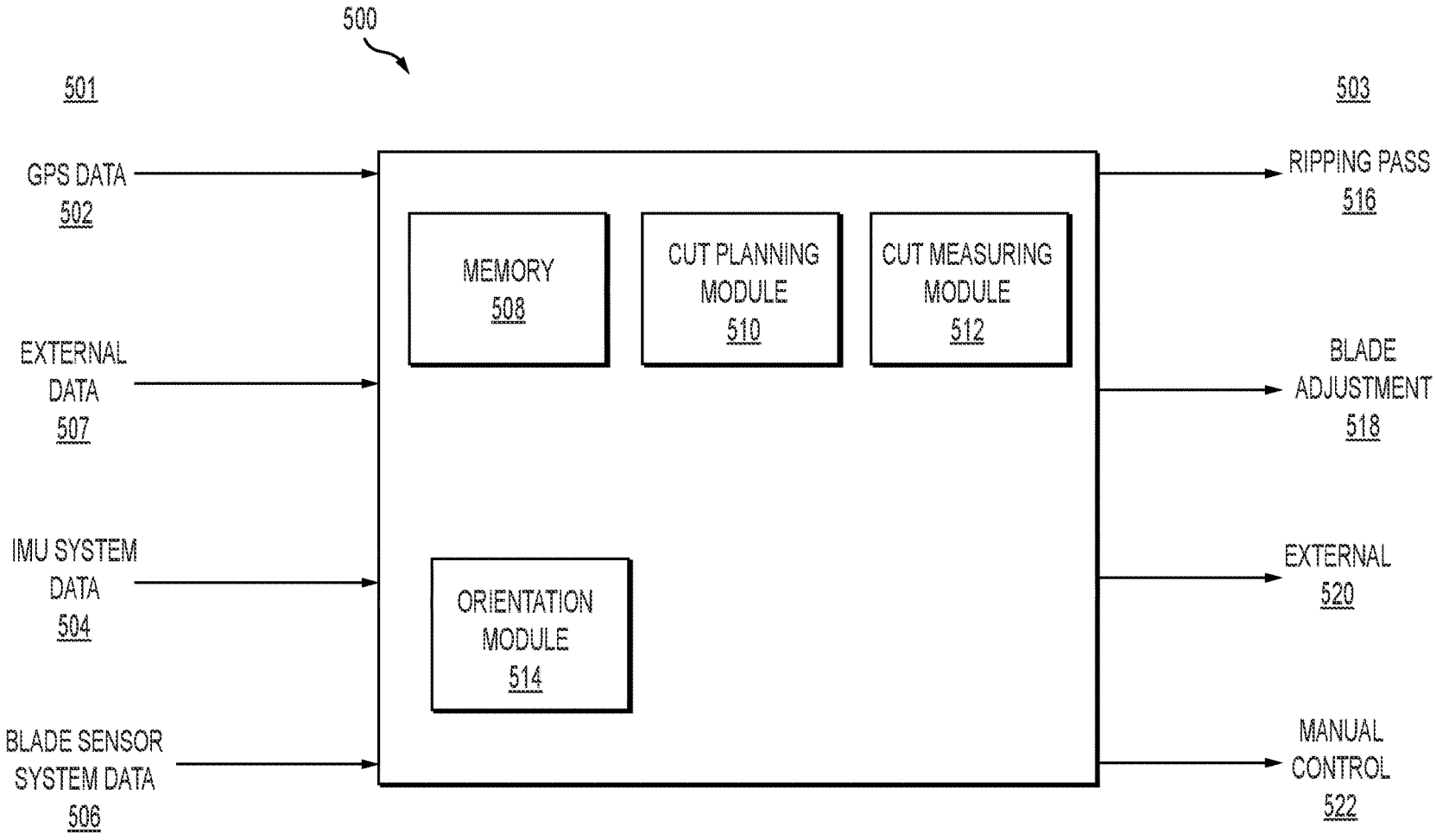
FIG. 6 shows a controller for causing one or more remedial actions based on a determination of insufficient cut penetration.

Referring now to FIGS. 1A-5B, the GPS 114 may be configured to determine a location of the mobile machine 101 or the mobile machine 201, which it may embody as GPS data, as described herein, especially with respect to FIG. 6. The GPS 114 may be configured to receive one or more signals from a global navigation satellite system (GNSS) (e.g., GPS system) to determine a precise location and/or orientation of the mobile machine 101 via geolocation. In some embodiments, the GPS 114 may provide an input to or be configured to interact with, update, or otherwise utilize one or more digital maps or worksite plans, such as an elevation map which may include one or more raster layers or other semantic layers. In some embodiments, the GPS 114 is configured to receive updates from an external network. The updates may include one or more of position data, speed/direction data, worksite plan data, weather data, or other types of data about the mobile machine 101 and its environment.

The IMU 116 may be an electronic device that measures and reports one or more features regarding motion of the mobile machine and/or its component parts (e.g., the blade 110). For example, the IMU 116 may measure a velocity, acceleration, angular rate, and or an orientation of the mobile machine 101 or one or more of its individual components using a combination of accelerometers, gyroscopes, and/or magnetometers. The IMU 116 may detect linear acceleration using one or more accelerometers and rotational rate using one or more gyroscopes. In some embodiments, the IMU 116 may be communicatively coupled to one or more other systems, for example, the GPS 114 and may provide an input to and receive an output from the GPS 114, which may allow components of the system 100 to continue to dead reckon a location and/or orientation of the mobile machine 101 even when the GPS 114 cannot receive satellite signals. In some embodiments, the blade position sensor 118 comprises one or more IMUS such as the IMU 116.

Referring to FIGS. 3A-5B, the mobile machine 201 is used to perform cuts in a current terrain profile 220 based on a target terrain profile 222. The current terrain profile may be determined, for example, using GPS track mapping, one or more perception systems (e.g., a vehicle-based perception system), drone terrain mapping (e.g., using visual or LiDAR image data), satellite imagery, etc. The target cut profile 222 may be a profile for a desired cut or grade for removing constituent from a worksite, which profile may be generated, for example, using one or more terrain mapping modules, for instance in terrain mapping software.

FIG. 6 shows an exemplary controller 500 for controlling one or more aspects of the mobile machine 101 or the mobile machine 201. The controller 500 may receive inputs 501 and generate outputs 503. For example, the controller 500 may receive GPS data 502, IMU system data 504, blade sensor system data 506, and external data 507 (e.g., terrain mapping data from the drone 145 of FIG. 1). The controller 500 may include a memory 508, which may store, for example, one or more site plans for generating one or more target cut profiles. The controller may include, for example, a cut planning module 510, a cut measuring module 512, and an orientation module 514. The controller 500 may generate outputs 503 in response to the received input data. The outputs 503 may include, for example, a ripping pass signal 516 (e.g., using a ripper such as the ripper 160 of the larger mobile machine 158), a blade adjustment signal 518, an external signal 520, and/or a manual control signal 522.

The controller 500 may comprise a data processor, a microcontroller, a microprocessor, a digital signal processor, a logic circuit, a programmable logic array, or one or more other devices for controlling the mobile machine 101 in response to one or more of the inputs 501. Controller 500 may embody a single microprocessor or multiple microprocessors that may include means for automatically calculating and selecting a candidate trajectory. For example, the controller 500 may include a memory, a secondary storage device, and a processor, such as a central processing unit or any other means for accomplishing a task consistent with the present disclosure. The memory or secondary storage device associated with controller 500 may store data and/or software routines that may assist the controller 500 in performing its functions, such as the functions of the exemplary process 600 described herein with respect to FIG. 6. Further, the memory or secondary storage device associated with the controller 500 may also store data received from various inputs associated with the mobile machine 101. Numerous commercially available microprocessors can be configured to perform the functions of the controller 500. It should be appreciated that controller 500 could readily embody a general machine controller capable of controlling numerous other machine functions. Alternatively, a special-purpose machine controller could be provided. Further, the controller 500, or portions thereof, may be located remote from the mobile machine 101. Various other known circuits may be associated with the controller 500, including signal-conditioning circuitry, communication circuitry, hydraulic or other actuation circuitry, and other appropriate circuitry.

The memory 508 may store software-based components to perform various processes and techniques described herein of the controller 500, including the various modules. The memory 508 may store one or more machine readable and executable software instructions, software code, or executable computer programs, which may be executed by a processor of the controller 500. The software instructions may be further embodied in one or more routines, subroutines, or modules and may utilize various auxiliary libraries and input/output functions to communicate with other equipment, modules, or aspects of the mobile machine 101.

The cut planning module 510 may plan one or more cuts for a given worksite or job based on requirements using inputs to the controller 500. For example, the cut planning module 510 may determine a target cut profile, which may include a target cut volume. The cut planning module 510 may plan a single cut for the given volume, or may segment the target cut into a number of factional target cuts. The cut planning module 510 may receive GPS data 502 and IMU system data 504, for example, to determine cuts to be made using the blade 110. For example, the cut planning module 510 may locate a three-dimensional geographical beginning and endpoint for a particular cut. The cut planning module 510 may use data generated by the sensors and systems on the mobile machine 101 and/or external data 507 (e.g., terrain mapping data, e.g., from the drone 145 of FIG. 1) to plan cuts.

The cut measuring module 512 may measure a performed cut based on the principles described herein using one or more system inputs. For example, the cut measuring module 512 may measure a cut volume for a given cut using one or more of GPS data 502, IMU system data 504, blade sensor system data 506, and/or external data 507. The cut measuring module 512 may use the various data inputs to track the volume of a cut as it is made or after it is completed using relative geographic coordinates and/or relative positions of various sensors on board the mobile machine 101 during or after a cut is made. The cut measuring module 512 may compare the measured cut with the target cut to determine the volume of an actual cut as described in greater detail herein. The cut measuring module 512 may use data generated by the sensors and systems on the mobile machine 101 and/or external data 507 (e.g., terrain mapping data from the drone 145 of FIG. 1) to measure and compare cuts.

The orientation module 514 may receive inputs from the various system inputs 501 and may determine whether a cutting pass is successful or not based on the system inputs. For example, the orientation module 514 may receive one or more of GPS data 502, IMU system data 504, blade sensor system data 506, and/or external data 507 which it may use to determine a difference in orientation and/or position with respect to the various sensors generating the received data. In some embodiments, the received data (e.g., position and orientation data) may be tracked over time to determine how the mobile machine 101 and its various components move with respect to the various objects in the environment surrounding the mobile machine 101 (e.g., the ground, the terrain, etc.) and to portions of the mobile machine 101 itself (e.g., how the blade moves with respect to the chassis, how a front portion of the tracks move with respect to a rear portion of the tracks, etc.)

The outputs 503 include the ripping pass signal 516, the blade adjustment signal 518, the external signal 520, and the manual control signal 522. The ripping pass signal 516 may be an output generated within the controller 500 that causes the mobile machine 101 to perform a ripping pass in order to attempt to break up terrain into which the blade 210 poorly penetrated. The blade adjustment signal 518 may cause the mobile machine 101 to adjust a blade orientation, position, or other aspect in order to better penetrate the terrain over which it works. The external signal 520 may be a signal to another mobile machine or other equipment which may cause the other equipment to attempt to cut the terrain over which the mobile machine 101 could not cut. For example, the mobile machine 101 may call another larger machine and/or a machine with a different cutting implement (e.g., a ripper). The manual control signal 522 may be a signal to a manual operator of the mobile machine 101 that may cause the manual operator (e.g., a remote operator) to take local or remote control of the mobile machine 101 to attempt to cut the terrain.

INDUSTRIAL APPLICABILITY

Figure 7:
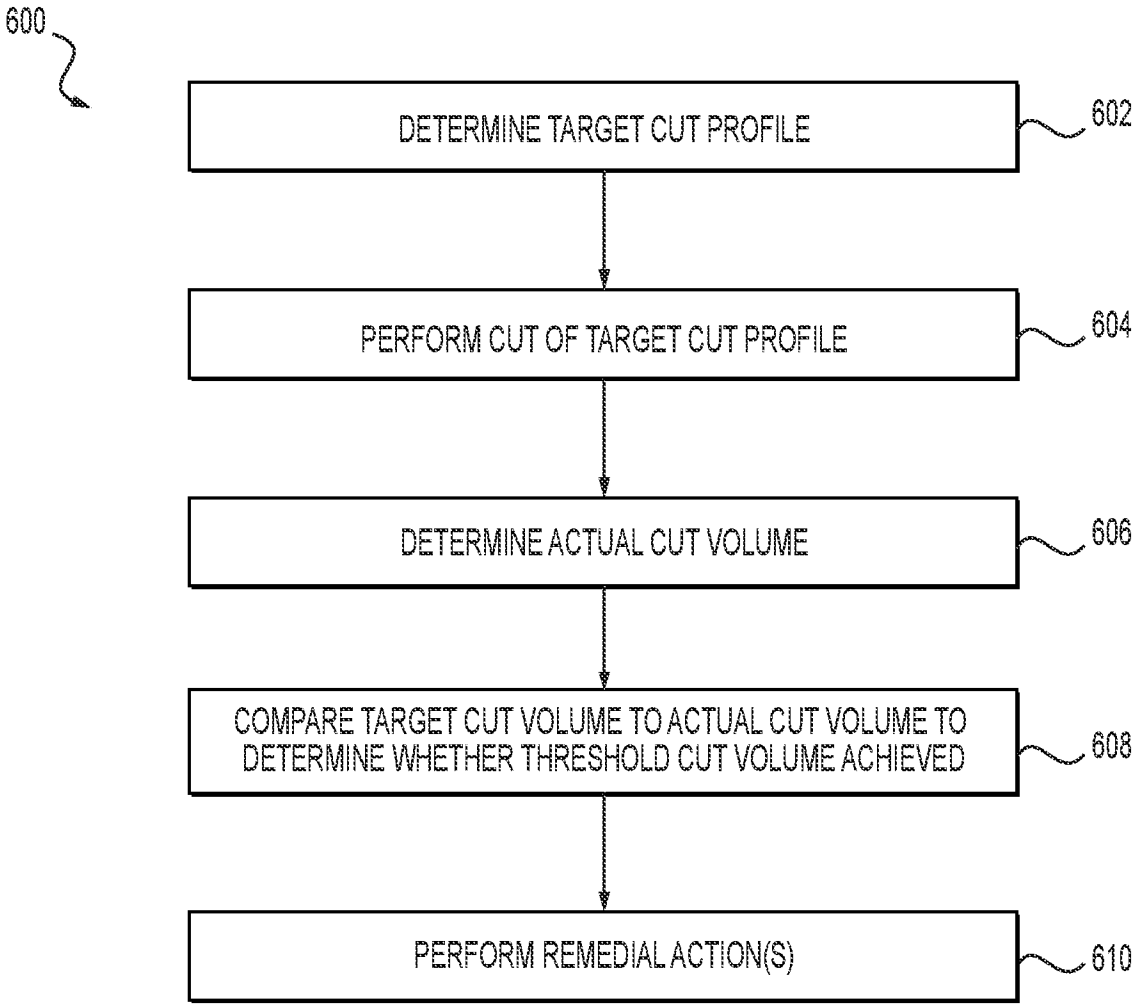
FIG. 7 shows a process for causing one or more remedial actions based on a determination of insufficient cut penetration using the system of FIGS. 1A and 1B.

Referring now to FIG. 7 a process 600 for determining and supplementing poor blade penetration using the systems of FIGS. 1A, 1B, and 5 is shown. The process 600 is exemplary and could be implemented using more or fewer steps or other features and aspects as those depicted in the exemplary illustrations.

At step 602, a target cut profile 122, which includes a target cut volume, may be determined. The target cut profile 122 may be determined, for example, based on input from one or more of the mobile machine 101 (e.g., from the GPS 114, the IMU 116, etc.), the drone 145 (e.g., from camera and/or LiDAR data), or other input, which may be used to generate plans for the worksite and may include features such as grades, grade lines, cut plans, and other features and/or patterns of a worksite. The target cut profile 122 shown in FIG. 1A is two-dimensional, but in practice, a target cut profile 122 is a three-dimensional plan, which may be followed by the mobile machine 101 to remove constituent from the work site. The target cut profile 122 may be stored on the mobile machine 101, for example, in the memory 508, in another module of the controller 500, or in another location. In some embodiments, the target cut profile 122 may not be stored locally on the mobile machine 101 but may be received using an external connection, for example.

At step 604, the mobile machine 101 may attempt to perform a cut of the terrain, attempting to follow or cut along the target cut profile 122, using, for example, the blade 110 or another implement suitable for cutting the profile. The blade 110 may scrape, push, dig, or otherwise move constituent to form the cut. If the targeted portion of ground beneath the mobile machine 101 is too hard for the blade 110 to penetrate, the mobile machine 101 may simply drive over the constituent at the target cut profile 122 without actually penetrating the constituent and hence will not push any, or very little, constituent. Hence, instead of penetrating the terrain and performing the desired cut, the mobile machine 101 may merely move some of the desired cut profile, if it moves any at all. More specifically, the blade 110 may not penetrate such that mobile machine 101 can cut to a threshold cut volume. As shown in FIG. 1B, the actual cut volume 126 is moved or removed from the target cut profile 122.

At step 606, the mobile machine 101 may determine the actual cut volume 126 of the cut made at step 604. As mentioned, the actual cut made will not necessarily equal the target cut volume 123, especially for terrain that is difficult to cut (e.g., hard terrain such as rock, ice, etc.) To determine the actual cut volume 126, the mobile machine may calculate a volume based on the position of its various sensors over time. The sensors (i.e., the GPS 114 and the various IMUS) will move as the mobile machine 101 moves to make its cut and track their location as they move. The orientation of the various sensors along the track can be used to determine the volume of the cut.

At step 608, the mobile machine 101 may compare the target cut volume 123 to the actual cut volume 126 (the system 100 may determine, for example, a remaining cut volume 124), and may determine whether the threshold cut volume has been achieved. The threshold cut volume may be, for example 1% of the target cut volume, 2% of the target cut volume, 5% of the target cut volume, etc. The threshold cut volume is a way for the system 100 to determine whether an additional cut and/or other remedial actions need to occur. A cut larger than the threshold cut volume may indicate to the system that the cut was effective. A cut smaller than the threshold cut volume may indicate an ineffective cut.

At step 610, the mobile machine 101 may cause one or more remedial actions to take place. For example, the mobile machine 101 may perform a second pass over the targeted terrain to try and perform a second cut or multiple cuts along the target cut profile 122. Additionally, the mobile machine 101 may cause an adjustment to a blade tilt angle 150 (FIG. 1B) of the blade 110. That is, the mobile machine 101 may cause the blade to tilt at an angle that is more suitable for cutting in the terrain using, for example, a blade control signal. In some embodiments, the mobile machine 101 may generate an external signal (e.g., a paging signal), which may page another mobile machine to perform a second cutting pass over the target cut profile 122. For example, the mobile machine 101 may call a second, larger machine with a different type of and/or larger implement for cutting the target cut profile 122. In some embodiments, a remote or local manual operator may take manual control of the mobile machine 101 after the remote or local manual operator receives a manual control signal 522 that is generated by the mobile machine 101.

Figure 3A:
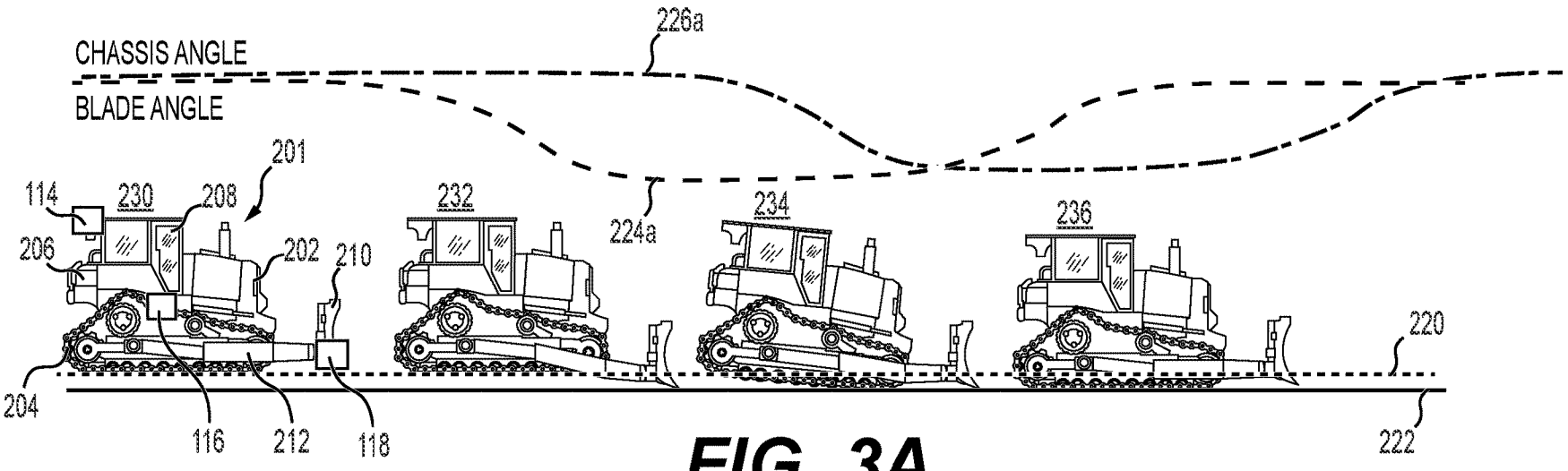
FIG. 3A is a schematic representation of a mobile machine similar to the mobile machine of FIG. 1A, that uses one or more sensors to determine sufficient cut penetration.
Figure 3B:
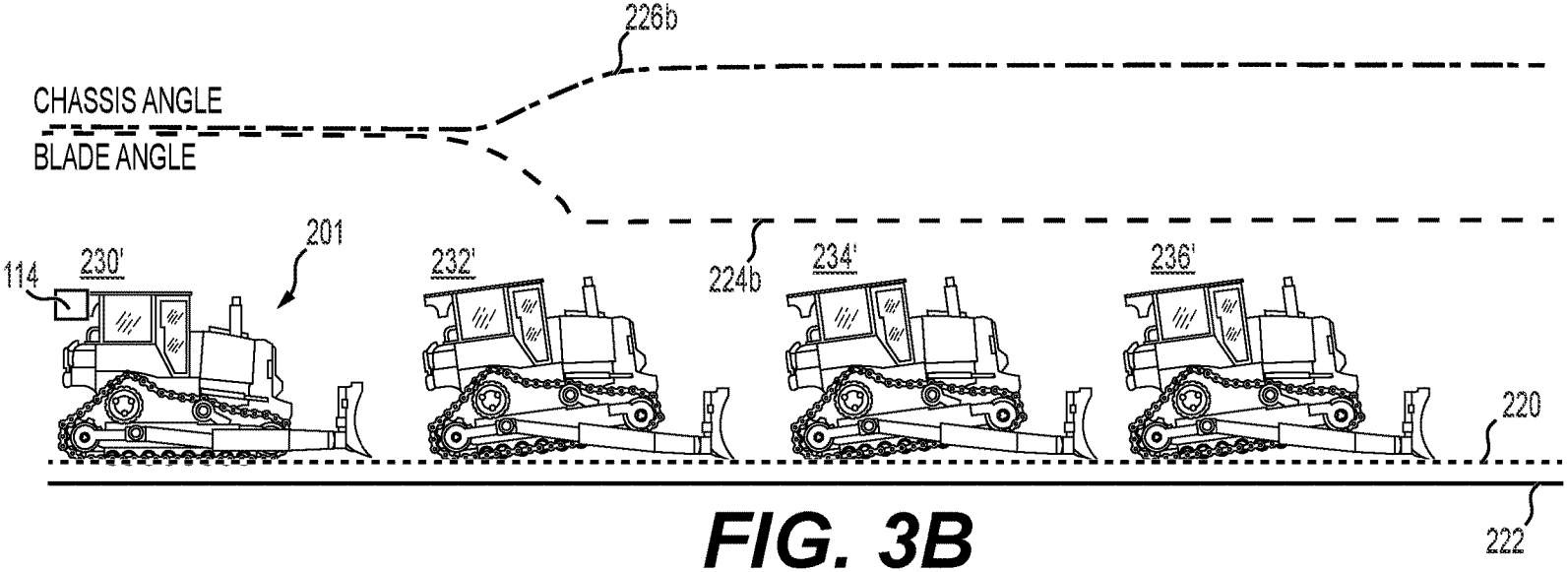
FIG. 3B shows the mobile machine of FIG. 3A in a scenario in which insufficient cut penetration could be detected using input from sensors.
Figure 8:
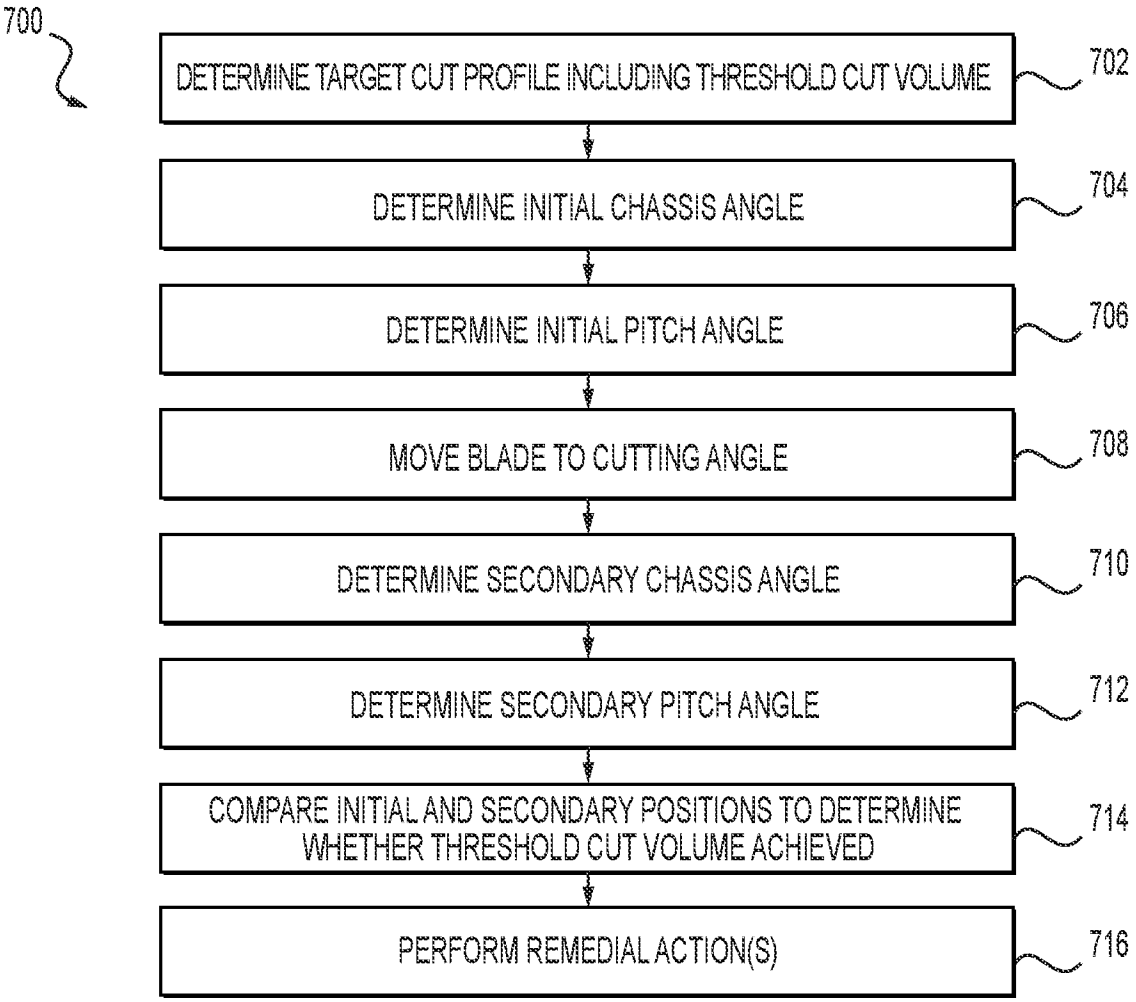
FIG. 8 shows a process for causing one or more remedial actions based on a difference between angles of various components of the mobile machine of FIGS. 3A and 3B.

Referring now to FIGS. 3A, 3B, and 8, a method for determining whether sufficient penetration has been achieved with an implement and generating one or more actions in response thereto is shown. The mobile machine 201 includes a blade sensor 118 at the blade 210 (which may be similar to the IMU 116) and determines a position and/or orientation of the blade 210 based on a signal from the blade sensor 118. The mobile machine 201 also includes the IMU 116, which may generate a position and/or orientation signal based on a position/orientation of the mobile machine 201. Specifically, the blade sensor 118 and the IMU 116 are configured to generate an angle of the blade 210 and the body 206 (or chassis) of the mobile machine 201.

At step 702, the mobile machine 201 may determine a target cut volume, which may include a threshold cut volume. At step 704, the mobile machine 201 may determine an initial chassis angle of a chassis of the mobile machine 201. The initial chassis angle may be determined, for example, using the IMU 116, which may be coupled to the main body 206 of the mobile machine 201. At step 706, the mobile machine 201 may determine an initial pitch angle at a blade of the mobile machine. The initial pitch angle may be determined, for example, using the blade sensor 118. As used herein, the terms chassis angle and pitch angle of the blade (or simply "pitch angle") refer to the angle of the chassis and the blade, respectively, as measured with respect to gravity. More specifically, the pitch angle of the blade does not refer to the "blade angle" as commonly used to refer to a blade angle of an implement with respect to a chassis of a mobile machine. As shown in FIG. 3A, the mobile machine 201 may proceed forward along the current terrain profile 220. The mobile machine 101 may comprise a desired terrain profile 222 programmed into its controller (e.g., in the memory 508 of the controller). The mobile machine 201 must cut the current terrain profile 220 in order to achieve the desired terrain profile 222. Plots of pitch angle 224*a*, 224*b* of the blade and chassis angle 226*a*, 226*b* are shown comparing the pitch angle of the blade with the chassis angle for the two scenarios depicted in FIGS. 3A and 3B.

At step 708, the mobile machine 201 may move the blade 210 from its position at the initial pitch angle to a cutting angle. For example, the mobile machine 201 may apply hydraulic pressure to one or more hydraulic cylinders in an attempt to force the blade 210 downward, into the constituent (i.e., perform a cut).

At step 710, with the blade 210 in the cutting position as compared with the main body 206 of the mobile machine 201, the mobile machine 201 may determine a secondary chassis angle of the mobile machine 201. At step 712, the mobile machine 201 may determine a secondary pitch angle of the blade of the mobile machine 201. As shown in FIGS. 3A and 3B, if the blade 210 of the mobile machine 201, experiences good penetration, chassis angle will follow the pitch angle in a lagged fashion. That is, a graphical representation of the angles taken by both will generally lower, and then return to neutral as the blade is lowered and then is subsequently followed by the chassis. However, if the blade does not penetrate or only partially penetrates as shown in FIG. 3B, the blade position will change with respect to the chassis (i.e., hydraulic cylinders pressurized to lower the arm 212) but the chassis angle may actually increase because the blade is forced downward but may not fully penetrate or may not penetrate the constituent (e.g., rock, ice, etc.) Hence, the chassis may lift off of the ground and a difference between the pitch angle of the blade and the chassis angle may develop.

FIG. 3A shows a scenario in which good cut penetration is achieved. The mobile machine 201 proceeds forward from a first position 230 to a second position 232. At the second position 232, the mobile machine 201 lowers its blade into the earth from the current terrain profile 220 to the desired terrain profile 222. The blade 210 does not meet significant resistance and is not prevented from penetrating the terrain. Accordingly, the blade 210 lowers a desired angle into the terrain. As the mobile machine 201 continues to move from the second position 232 to a third position 234, the chassis of the mobile machine 201 will follow the blade 210 and the blade 210 and the mobile machine 201 remain at the desired terrain profile 222 from the third position 232 to a fourth position 236. The motion of the mobile machine 201 and the blade are depicted graphically in the plots of pitch angle 224*a* of the blade and chassis angle 226*a*. The chassis angle 226*a* follows the pitch angle 224*a* of the blade smoothly as the blade 210 moves from a neutral angle (first position) to a negative angle (second and third positions) and back to a neutral angle (fourth position).

FIG. 3B shows a scenario in which sufficient blade penetration is not achieved. That is, the blade 210 only penetrates a slight amount and does not penetrate the current terrain profile 220 to the desired terrain profile 222. As the mobile machine 201 moves from a first position 230' to a second position 232', the blade 210 moves from a neutral angle to a negative angle to begin the cut. However, the ground is only semi-penetrable, and so the hydraulic forces generated in the arm 212 on the blade actually cause the body 206 of the mobile machine 201 to lift off of the ground or otherwise indicate to the mobile machine that there is insufficient blade penetration. The pitch angle of the blade is negative, because the blade is not on an equal plane with the body of the mobile machine 201, but the blade does not sufficiently cut the terrain. Accordingly, as the mobile machine 201 moves from the second position 232' to a third position 234' and a fourth position 236', the angle of the chassis of the mobile machine 201 does not follow the pitch angle of the blade. The plots of the body angle 224*b* and pitch angle 226*b* of the blade show this divergence. Based on the divergence, the mobile machine 201 may cause one or more remedial actions to take place.

At step 714, the mobile machine 201 may compare the initial and secondary positions to determine whether a threshold cut volume has been achieved. That is, if the secondary positions of the chassis and the pitch angle of the blade do not follow their expected path for an effective cut, the system 100 may determine that the threshold cut volume is not achieved.

At step 716, the mobile machine 201 may take one or more remedial actions based on a difference between the initial pitch angle and the secondary pitch angle and a difference between the initial chassis angle and the secondary chassis angle (e.g., if the system determines that a threshold cut volume is not achieved). For example, the mobile machine may perform a ripping pass over the target cut profile, may make an adjustment to a blade tilt angle of a blade, may page a second machine to perform a cutting pass over the target cut profile, and may perform a manually-controlled pass over the target cut profile.

The scenarios depicted in FIGS. 4A/4B and 5A/5B are similar to the scenario depicted in FIGS. 3A/3B in that they use the input from IMUs or other sensors to determine the efficacy of a cut, except they do not use chassis angle and/or pitch angle of the blade, but instead use one or more stamping profiles as determined at one or more locations on the body of the mobile machine 201 (e.g., at the blade, at a track, etc.) As used herein, the term "stamping profile" refers to position/orientation/GPS meta data which is tagged, geo-tagged, or otherwise affixed to data from a given GPS or IMU sensor for a given time. In some embodiments, the system 100 may cause a specific Northing/Easting position to be tagged with two measured elevations (e.g., blade elevation and front track elevation, front track elevation and rear track elevation, etc.) In some embodiments, a leading position may be tagged (or "stamped") with the elevation, and subsequently (e.g., after one second, after two seconds, after three seconds, etc.) the trailing position may be stamped. FIGS. 4A and 4B show a scenario in which stamping profiles are determined at a blade edge 210*a* and a front portion of a right track 204. In the exemplary scenario, the stamping profiles are determined using the blade sensor 118 (which could be embodied by an IMU), the IMU 116, and a global positioning referenced sensor, such as the GPS 114. Referring to FIGS. 4A and 4B, the mobile machine 201 is shown. The IMU 116 at the front of the track 204 may generate a front track profile 324*a*, 324*b* and the blade sensor 118 may generate a blade edge profile 326*a*, 326*b*. The front track stamping location may generally be near a front side of one or both of the left track (not depicted) and right track 204. Because of its location near the front of the blade, the front track stamping location 302 may generally follow a location of the blade when the mobile machine 201 experiences good penetration with the blade when performing a cut.

Figure 9:
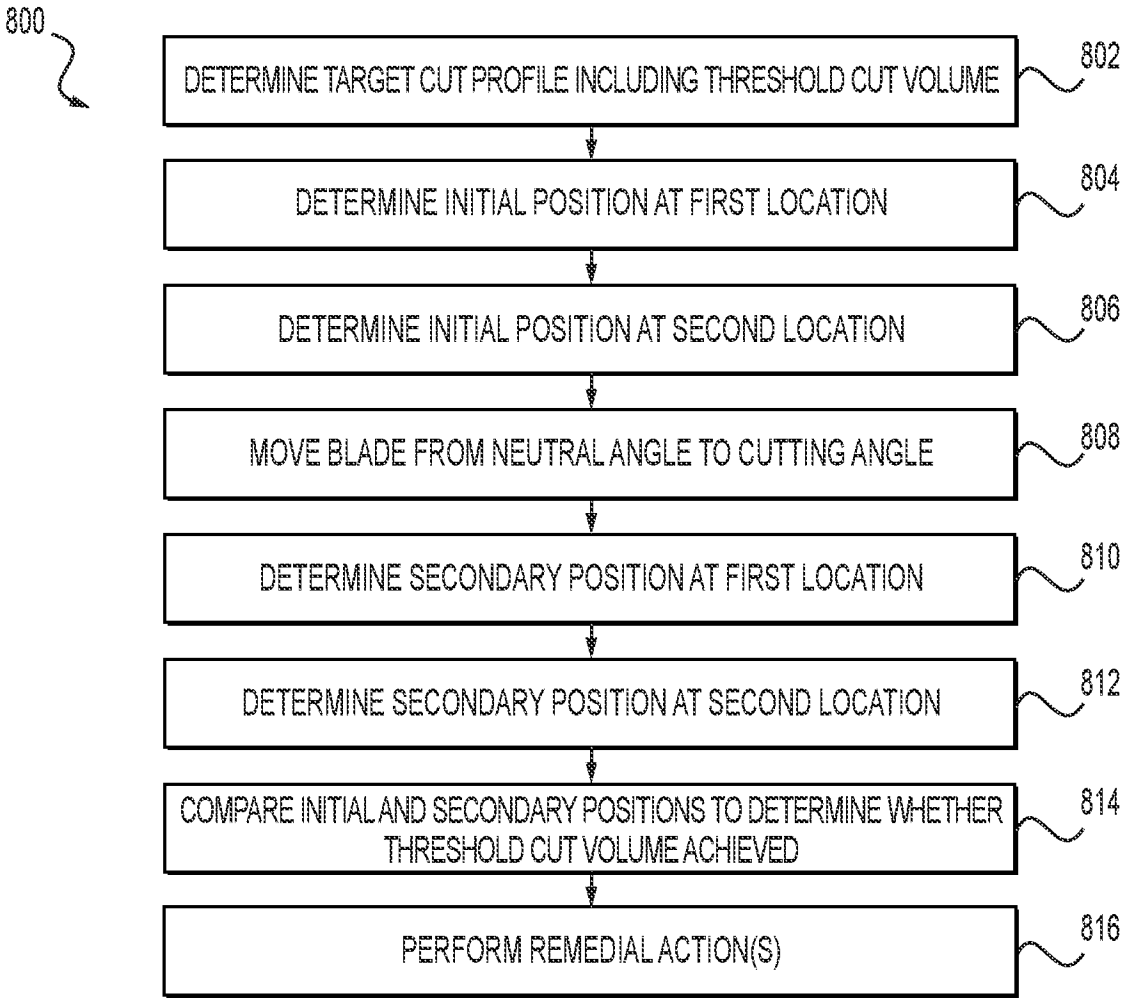
FIG. 9 shows a process for causing one or more remedial actions based on a difference in positions between various sensors on the body of the mobile machine of FIGS. 4A, 4B, 5A, and 5B.

Referring to FIGS. 4A, 4B, and 9, the process 800 is described. The current terrain profile 220 is shown above the desired cut profile 222. At step 802, the mobile machine 201 may determine a target cut volume, which may include a threshold cut volume. At step 804, the mobile machine 201 determines an initial position at a first location on the mobile machine 201. The first location is as at the blade edge 210*a* and the position is determined based on the blade sensor 118. At step 806, the mobile machine 201 determines an initial position at a second location on the mobile machine 201. The second location is the front portion of the track 204. As the mobile machine moves from the first position 330 to a second position 332 and on to a third position 334, the blade is moved from the neutral angle to a cutting angle at step 808.

With the blade 210 in the cutting angle, the mobile machine 201 can determine a secondary position at the first location at step 810 and a secondary position at the second location at step 812. As shown in FIG. 4A, if the blade 210 achieves proper penetration, the front track profile 324*a* will follow the blade edge profile 326*a* closely as the mobile machine moves from the first position 330 to the fourth position 336. However, if the blade 210 fails to achieve proper penetration as it moves along its path, the front track profile 324*b* does not follow the blade edge profile 326*b*.

At step 814, the mobile machine 201 may compare the initial and secondary positions to determine whether a threshold cut volume has been achieved. That is, if the secondary positions of the chassis and the pitch angle of the blade do not follow their expected path for an effective cut, the system 100 may determine that the threshold cut volume is not achieved. Based on this divergence, the mobile machine 201 can cause one or more remedial actions to take place at step 816.

FIGS. 5A and 5B depict another scenario in which IMUs or other sensors can be used to determine whether successful terrain penetration is achieved. The mobile machine 201 of FIGS. 5A and 5B is similar to the mobile machine 201 of FIGS. 4A and 4B and has a GPS 114 and one or more IMUs, (e.g., an IMU 116*a* at a front portion of the track 204, an IMU 116*b* at a rear portion of the track 204, or an IMU at some other fixed and known location with respect to the GPS position). The IMU 116*a* at the front of the track 204 may generate a front track profile 424*a*. The front track stamping location may generally be near a front side of one or both of the left track (not depicted) and right track 204. Because the mobile machine 201 is a rigid body with a known geometry, only a single stamping location with respect to the GPS may be required to measure the positions of both the front and rear tracks of the mobile machine. That is, using known dimensions of the chassis and tracks, the measured GPS position can be translated to the front and rear tracks. The IMU 116*b* is shown for illustrative purposes to show that the stamping location could be at any location on the chassis or otherwise at a fixed location with respect to the body of the mobile machine 201.

As shown in FIG. 5A, as the mobile machine 201 progresses along its intended track from a first position 430 to a second position 432 and to a third position 434, the blade moves from a neutral angle to a cutting angle and achieves good penetration. As the mobile machine 101 continues to move forward, the front track profile 424*a* and the rear track profile 426*a* will appear similar because the rear track stamping location (which is either calculated based on its known position with respect to the IMU 116*a* or may be associated with the IMU 116*b*) will follow the front track stamping location (associated with the IMU 116*a*).

However, as shown in FIG. 5B, if the blade 210 does not achieve good penetration as the mobile machine 201 moves from a first position 430' to a second position 432' to a third position 434' and a fourth position 436', a front portion of the mobile machine 201 will lift up off of the ground due to the hydraulic force on the blade 210 (and thus the terrain 220) through the arm 212 of the mobile machine 201. Based on the failure to achieve proper penetration, the mobile machine 201 can cause one or more remedial actions to occur as described herein.

It should now be understood that a mobile machine including various sensors (e.g., GPS, IMU, etc.) can be used to determine whether sufficient penetration of an implement of the mobile machine has been achieved. To determine whether sufficient penetration has been achieved, a controller of the mobile machine may compare, for example, a threshold cut volume to a volume that is actually cut by the mobile machine. Based on the determination of penetration as sufficient or insufficient, the mobile machine may cause one or more remedial actions to occur in order to ensure that the ground at the work site will eventually be penetrated and can be machined per work site requirements. The autonomous capabilities of the mobile machine to determine its own insufficient penetration and cause remedial actions in response thereto to eventually achieve sufficient penetration enable the mobile machine to operate with greater autonomy in more environments, thereby reducing the need for a human operator(s) in environments where human operation is impossible and/or undesirable.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A method of operating a blade-based machine at a work site, the method comprising:

attempting to cut an area of ground by the blade-based machine at the work site;

determining that a threshold cut volume is not achieved during the attempted cut by the blade-based machine, the determination that the threshold cut volume is not achieved being based on a divergence between a first profile and a second profile, wherein a first position sensor is installed at a first location on a blade of the blade-based machine, wherein the first profile is generated by movement of the first position sensor during the cut, based on a movement of the first position sensor during movement of the machine across the ground, wherein a second position sensor is installed at a second location on the blade-based machine other than the blade, wherein the second profile is generated by movement of the second position sensor during the cut, based on the movement of the second position sensor during movement of the machine across the ground; and initiating one or more remedial actions based on the determination that the threshold cut volume is not achieved.

2. The method of claim 1, further comprising:

determining a target cut profile based on the area of ground, including a target cut volume before attempting to cut the area of ground;

determining an actual cut volume based on input from the first and second position sensors; and comparing the target cut volume to the actual cut volume to determine that the threshold cut volume is not achieved.

3. The method of claim 2, wherein the target cut volume is based on a size of the blade.

4. The method of claim 2, wherein the target cut profile is based on GPS track mapping and/or drone terrain mapping.

5. The method of claim 2, wherein the target cut profile is based on a current terrain profile perceived by a perception system of the blade-based machine.

6. The method of claim 2, wherein the threshold cut volume is 5% of the target cut volume.

7. The method of claim 1, wherein the first and second position sensors are configured to generate data including at least one of:

global positioning system data; and inertial measurement unit system data.

8. The method of claim 1, further comprising:

determining an initial position of the first position sensor;

determining an initial position of the second position sensor;

moving the blade from a neutral angle to a cutting angle;

determining a second position of the first position sensor; and determining a second position of the second position sensor;

wherein the generating the first profile is based on movement of the first position sensor between the initial position and the second position of the first position sensor, and the generating the second profile is based on movement of the second position sensor between the initial position and the second position of the second position sensor.

9. The method of claim 8, wherein the second location of the second position sensor is a position on a portion of a chassis of the blade-based machine.

10. The method of claim 8, wherein the second location of the second position sensor is a position on a front portion of a track of the blade-based machine.

11. The method of claim 8, wherein the second location of the second position sensor is a position on a rear portion of the blade-based machine.

12. The method of claim 1, wherein the one or more remedial actions comprises:

a ripping pass over the ground;

an adjustment to a blade tilt angle of the blade;

a second machine performing a cutting pass over the ground; or a manually-controlled pass over the ground.

13. A method for evaluating cut penetration of a cut made using a mobile machine and generating one or more remedial actions based thereon, comprising:

determining an initial chassis angle of a chassis of the mobile machine;

determining an initial pitch angle of a blade of the mobile machine, the initial pitch angle measured with respect to gravity;

moving the blade from the initial pitch angle to a cutting angle;

determining a second chassis angle of the mobile machine during the cut, as the machine moves in a forward direction across a ground surface, to provide a first profile;

determining a second pitch angle of the mobile machine during the cut, as the machine moves in the forward direction across the ground surface, to provide a second profile, the initial pitch angle measured with respect to gravity;

determining that there is a divergence between the first profile and the second profile generated by movement of the mobile machine during the cut, and one or more remedial actions are required; and taking the one or more remedial actions.

14. The method of claim 13, further comprising displaying on a display a status indicating the one or more remedial actions are required.

15. The method of claim 13, wherein the mobile machine is a track-type tractor.

16. The method of claim 13, wherein the one or more remedial actions comprises:

a ripping pass over a target cut profile;

an adjustment to a blade tilt angle of the blade;

a second machine performing a cutting pass over the target cut profile; or a manually-controlled pass over the target cut profile.

17. A system for initiating one or more remedial actions based on a determination that ground is impenetrable by a blade of a blade-based machine, the system comprising:

a blade-based machine including a blade and one or more position sensors on the blade-based machine; and a controller configured to:

determine a threshold cut having a minimum blade penetration necessary to achieve the threshold cut;

determine that the threshold cut is not achieved based on input from position sensors on the blade-based machine, wherein the controller is configured to determine that the threshold cut is not achieved by:

measuring movement of a first position sensor installed at a location on a blade of the blade-based machine during the cut, as the machine moves across the ground, measuring movement of a second position sensor installed at a location other than the blade on the blade-based machine during the cut, and during measurement of the movement of the first position sensor, generating a first profile based on the movement of the first position sensor installed on the blade of the blade-based machine, generating a second profile based on the movement of the second position sensor installed on the blade-based machine, and comparing the first profile and the second profile to determine that the first and second profiles diverge from one another and thus the threshold cut is not achieved; and initiate one or more remedial actions because the threshold cut is not achieved.

18. The system of claim 17, wherein the controller is further configured to:

determine an initial position of the first position sensor;

determine an initial position of the second position sensor;

move the blade from a neutral angle to a cutting angle;

determine a second position of the first position sensor; and determine a second position of the second position sensor;

wherein the generating the first profile is based on movement of the first position sensor between the initial position and the second position of the first position sensor, and the generating the second profile is based on movement of the second position sensor between the initial position and the second position of the second position sensor.

19. The method of claim 1, wherein the first and second profiles are not generated prior to the movement of the machine.

20. The method of claim 1, wherein the first profile indicates a path traversed by the first position sensor, and the second profile indicates a path traversed by the second position sensor, during the movement of the machine.

* * * * *